United States Patent [19]

Saito et al.

[11] 4,397,831

[45] Aug. 9, 1983

[54] PRODUCTION OF CARBON FIBERS FROM ACRYLONITRILE BASED FIBERS

[75] Inventors: Kazuhisa Saito; Hiroyasu Ogawa, both of Shizuoka, Japan

[73] Assignee: Toho Belson Co., Ltd., Tokyo, Japan

[21] Appl. No.: 200,623

[22] Filed: Oct. 27, 1980

[30] Foreign Application Priority Data

Oct. 25, 1979 [JP] Japan ..... 54-137979

[51] Int. Cl.[3] ..... D01F 9/22

[52] U.S. Cl. ..... 423/447.6; 423/447.2; 423/447.4; 423/447.5

[58] Field of Search ..... 423/447.6, 447.5, 447.4, 423/447.1; 264/29.2

[56] References Cited

U.S. PATENT DOCUMENTS 4,069,297 1/1978 Saito et al. ..... 423/447.6

4,197,279 4/1980 Saito et al. ..... 423/447.5 X

FOREIGN PATENT DOCUMENTS 46-41650 6/1971 Japan ..... 423/447.5

*Primary Examiner*—Edward J. Meros

*Attorney, Agent, or Firm*—Sughrue, Mion, Zinn, Macpeak & Seas

[57] ABSTRACT

An acrylonitrile based fiber is disclosed which is composed of copolymers comprising at least 96 mole % of acrylonitrile and $1\times10^{-2}$ to $70\times10^{-2}$ mole % of a vinyl component or vinyl components containing acidic groups, and containing a specific amount of zinc. The fiber is used in production of oxidized or flame resistant fiber. The oxidized or flame resistant fiber is produced by heat-treating or oxidizing the acrylonitrile based fiber in an oxidation furnace equipped with a plurality of roller units while limiting the shrinkage of the acrylonitrile based fiber within specific limits as the oxidation proceeds. On carbonizing the above oxidized or flame resistant fiber while limiting the shrinkage thereof a carbon fiber which is of high strength and low fluffing is obtained.

2 Claims, 2 Drawing Figures

PRODUCTION OF CARBON FIBERS FROM ACRYLONITRILE BASED FIBERS

BACKGROUND OF THE INVENTION

1. Field of the Invention

This invention relates to acrylonitrile based fibers, oxidized or flame resistant acrylonitrile based fibers obtained by heat-treatment of said acrylonitrile based fibers, carbon fibers obtained by heat-treatment of said oxidized acrylonitrile based fibers, and processes for the production thereof. In accordance with this invention, the time required for oxidation of acrylonitrile based fibers is shortened, and carbon fibers of low fluffing and high strength are obtained.

2. Description of the Prior Art

It has hitherto been known that carbon fibers can be obtained by subjecting acrylonitrile based fibers as the precursor to oxidation treatment (a treatment whereby the fibers are rendered flame resistant) to provide flame resistant fibers and by carbonizing the flame resistant fibers. In this method, however, the time required for the oxidation is quite long, leading to the high production costs of the flame resistant fibers and carbon fibers. Therefore, there has been only a limited demand for these fibers although they have excellent properties.

Furthermore, because of the long oxidation time required, oxidation of a strand of acrylonitrile based fibers is usually carried out in an oxidation furnace provided with a plurality of roller units. In this oxidation treatment, however, some of fibers in the strand are often cut and caused to wind around the rollers. Therefore, operation troubles, formation of strands of high fluffing, and various other problems are likely to take place.

On the other hand, with regard to increasing the strength of carbon fibers, various procedures have been proposed with a certain degree of success, and the strength of the carbon fibers which was initially as low as 200 kg/mm$^2$ has now been markedly increased. Recently, however, carbon fibers having much higher strengths have been desired.

In order to remove the above described problems, for example, to shorten the time required for the oxidation and to produce strands of higher strength and low fluffing, various investigations have been made. As a result of these investigations, the following findings have been made;

(1) To increase the oxidation rate, copolymerization of acrylonitrile with vinyl monomers containing acidic groups, and incorporation of zinc into acrylonitrile based fibers have been used in the art. It has now been found that when zinc is incorporated into acrylonitrile based polymers consisting of acrylonitrile and vinyl components containing acidic groups, the increase in the oxidation rate of the resulting fibers is greater than separately attained by the copolymerization and the incorporation of zinc. It is also known that the incorporation of zinc into acrylonitrile based fibers results in the production of carbon fibers having increased strength. However, when the content of the zinc in the acrylonitrile based fibers containing acidic groups is more than equimolar the amount of the acidic group, the strength of the carbon fibers obtained from the acrylonitrile based fibers is low. This is considered due to the fact that when a shear force is applied among the molecules constituting the fiber, it is concentrated at the excess zinc.

In general, acrylic fibers are apt to coalescence (stick together) during oxidation and carbonization. The phenomena of coalescence makes adverse effect on strength of the resultant fiber. However, it has been recognized that the fiber specified in the invention can minimize coalescence during oxidation and carbonization.

(2) As the oxidation reaction proceeds, the fiber shrinks. This shrinkage can be divided into a shrinkage caused by the relaxation of the molecular orientation at the beginning of the oxidation reaction, and a shrinkage caused by a cyclization reaction at the late stage of the oxidation reaction. These shrinkages can be distinguished on the basis of the amount of the bonded oxygen.

(3) The introduction of both acidic groups and zinc into acrylontrile based fibers accelerates the oxidation rate. Therefore, the shrinkage at the beginning of the oxidation reaction is greater and more rapid than with those fibers containing no acidic group and no zinc. This is considered due to fixation of the molecular orientation by the components introduced. Therefore, to fix the molecules in the highly oriented state, it is necessary to control the tension applied to the fibers.

(4) The shrinkage created by the cyclization reaction is lower with acrylonitrile based fibers containing zinc and acidic groups than with those fibers containing no zinc and no acidic groups. This is considered due to fixation of the molecular orientation as described above.

(5) Prior art methods required that the fibers be kept in a highly orientated state during oxidation by maintaining them under tension, although the fibers become weaker as the oxidation proceeds. This results in the formation of strands of high fluffing. However, if the molecular orientation is, as described above, fixed at the beginning of the oxidation treatment, it is not necessary to apply high tension. This leads to the reduction in the formation of fluffs.

SUMMARY OF THE INVENTION

This invention provides:

(a) An acrylonitrile based fiber for use in production of an oxidized or flame resistant fiber, said acrylonitrile based fiber being composed of copolymers comprising at least 96 mole% of acrylonitrile and $1\times10^{-2}$ to $70\times10^{-2}$ mole% of a vinyl monomer or vinyl components containing acidic groups wherein 50 to 100% (equivalent) of the counter ions of the acidic groups are substituted by zinc.

(b) A process for producing an oxidized or flame resistant fiber which comprises subjecting an acrylontrile based fiber defined in (a) to oxidation at 200° to 300° C. by use of a plurallity of roller units while limiting the shrinkage of said fiber to 20 to 50% of the free shrinkage, as determined for that stage of the oxidation reaction unitl the amount of bonded oxygen reaches 3 to 4% by weight, and upon further oxidation, limiting the shrinkage to 50 to 70% of the free shrinkage as oxidation proceeds.

(c) An oxidized or flame resistant fiber obtained by treating an acrylontrile based fiber defined in (a) by a process defined in (b).

(d) A process for producing a carbon fiber which comprises further carbonizing an oxidized or flame resistant fiber defined in (c) in a non-oxidizing atmosphere at 500° to 2000° C. while controlling the shrinkage of said fiber within the range of 40 to 70% of the free shrinkage thereof.

(e) A carbon fiber obtained by treating an oxidized or flame resistant fiber defined in (c) by a process defined in (d).

DETAILED DESCRIPTION OF THE INVENTION

Figure 1:
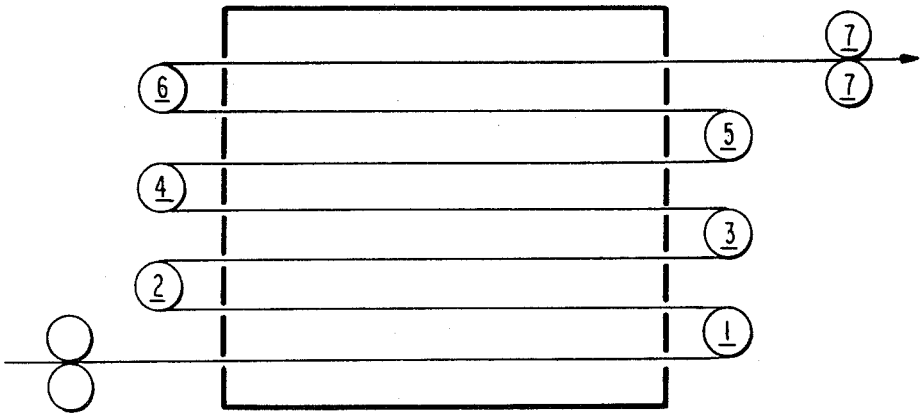
FIG. 1 is an illustration of an oxidation furnace provided with a plurality of roller units.

Vinyl monomers containing acidic groups are monomers copolymerizable with acrylonitrile, such as allylsulfonic acid, methallyl sulfonic acid, acrylic acid, methacrylic acid, itaconic acid, and their salts, such as sodium salts.

The amount of the vinyl components containing acidic groups is preferably $1\times10^{-2}$ to $70\times10^{-2}$ mole% of the monomers constituting the acrylonitrile based polymers or fibers, with the range of $5\times10^{-2}$ to $50\times10^{-2}$ mole% being especially preferred. When the amount is less than $1\times10^{-2}$ mole%, the oxidation rate or rate of rendering the fibers flame resistant is insufficiently increased. In the case of greater than $70\times10^{-2}$ mole%, the oxidation rate is excessively increased resulting in the formation of the two-layer structure in the fibers oxidized or rendered flame resistant. It is therefore, difficult to obtain carbon fibers of high strength. If necessary, neutral vinyl monomers, such as methylacrylate, methyl methacrylate, acrylamide and the like are copolymerized with acrylontrile and the above vinyl monomers.

The said acidic group in the fiber is generally introduced by copolymerizing of the above said vinyl monomers containing acidic groups, but also may be brought by polymerization catalyst. For example, sulfonic group can be introduced to polymer or fiber when persulfate compounds are used as catalyst.

The acrylonitrile based polymers or fibers of this invention must comprise at least 96 mole% acrylonitrile. When the acrylonitrile component is less than 96 mole%, the quality of the carbon fibers obtained is reduced as is well known.

Incorporation of zinc into the acrylonitrile based polymers or fibers may be carried out by simply discharging the fibes into an aqueous solution of water-soluble zinc compounds, such as zinc chloride, zinc sulfate and the like, during or after the water-washing for desolvation after the wet spinning. When a concentrated solution of zinc chloride in water is used as the solvent, the degree of desolvation by water-washing is controlled so that the zinc content is 50 to 100% equivalent of the acidic group contained in the acrylonitrile based polymer.

For spinning the acrylonitrile based polymers of this invention, those solvents usually employed in spinning acrylonitrile based polymers, such as organic solvents (e.g., dimethylformamide, dimethylsulfoxide, dimethylacetamide, ethylene carbonate, etc.), inorganic solvents (e.g., rhodanate, nitric acid, etc.), etc., are usable. In particular, the use of an aqueous solution of zinc chloride is preferred from the point of operation.

The oxidation of the acrylonitrile based polymer strands or the treatment rendering the strands flame resistant is carried out by passing the strands through an oxidizing atmosphere of oxygen, air or the like at a temperature of 200° to 300° C. using a plurality of roller units.

During this oxidation treatment, until the content of the bonded oxygen reaches 3 to 4% by weight based upon the weight of the acrylonitrile based polymer strand, the shrinkage of the strand is limited to 20 to 50% of the free shrinkage of the strand as the oxidation reaction proceeds. The reason for this is that since the acrylonitrile based fiber contains the acidic group-containing vinyl monomer as a copolymerizate and the zinc, the oxidation reaction proceeds rapidly, the free shrinkage is increased, and the fixing of the molecular orientation is accelerated.

In this invention, the shrinkage of the fiber is limited to lower levels as compared to those fibers wherein no such polymerization component and zinc are contained. That is to say, the oxidation treatment of the fiber is carried out while applying certain tension to the fiber and controlling the relaxation of the molecular orientation. When the shrinkage is limited to less than 20% of the free shrinkage, the fiber is often cut into single fibers at the beginning of the oxidation treatment, while when the shrinkage is more than 50% of the free shrinkage, a carbon fiber of high strength is not obtainable.

Upon subsequent oxidation, the fiber is subjected to oxidation while limiting the shrinkage within the range of 50 to 70% of the free shrinkage. When the shrinkage is limited to less than 50% of the free shrinkage, the cutting of the fiber into single fibers occurs with ease. On the other hand, when allowed to shrink more than 70% of the free shrinkage, a carbon fiber of high strength can not be obtained.

The term "free shrinkage" as used herein means the shrinkage of a fiber which is measured at each oxidation stage when the fiber is subjected to oxidation or carbonization while applying a load just sufficient that the fiber does not hang slack (about 1 mg/denier).

Carbonization in this invention is carried out in an inert atmosphere, for example, in an atmosphere of nitrogen, argon, helium or the like at a temperature of 500 to 2000° C. while limiting the shrinkage of the polymer or fiber within the range of 40 to 70% of the free shrinkage thereof. In this carbonization, when the shrinkage is limited to less than 40% of the free shrinkage, fluffing is marked and the operation is unstable. On the other hand, when the fiber is allowed to shrink more than 70% of the free shrinkage, the molecular orientation is disturbed and sufficient strength can not be obtained.

In this invention, acrylonitrile based fibers having specific compositions are employed and subjected to specific oxidation treatment. This leads to an increase in the oxidation rate and to the production of oxidized fibers having excellent qualities and physical properties. Furthermore, when these oxidized fibers are subjected to carbonization, carbon fibers which are of high strength and low fluffing can be obtained.

The following examples are given to illustrate this invention in greater detail.

EXAMPLE 1

An acrylonitrile based polymer consisting of 0.07 mole% of sodium methallyl sulfonate, 1.5 mole% of methyl acrylate and 98.43 mole% of acrylonitrile was dissolved in a 59% by weight solution of zinc chloride in water to provide a 9% by weight solution of the acrylonitrile based polymer. This polymer solution was discharged under pressure into a 25% by weight aqueous solution of zinc chloride through a nozzle having a hole diameter of 0.06 mm and a number of holes 6000. The fibers so obtained were then washed with water to remove the solvent.

During this desolvation, hydrochloric acid was added to the washing water so that the pH of the washing water was 4.3. Thus, zinc was incorporated into the fibers in a proportion of 0.704 milli equivalent/100 g fiber, which corresponded to 55% of the equivalent of the sulfonic acid contained in the fiber, i.e., 1.28 milli equivalent/100 g fiber. Furthermore, during the desolvation, the fibers were stretched to 4.2 times their original lengths and then dried.

Thereafter, the fibers were stretched to 3.4 times their original lengths in saturated steam of 120° C., and acrylonitrile based strands of single fiber denier 0.7 and 6000 filaments were thus obtained.

The thus obtained acrylonitrile based fiber had a tensile strength of 6.8 g/denier, tensile elongation of 8.5% and Young's modulus of 100 g/denier.

EXAMPLE 2

An acrylonitrile based polymer consisting of 0.25 mole% of sodium methallyl sulfonate, 1.59 mole% of methyl acrylate and 98.16 mole% of acrylonitrile was dissolved in a 58% by weight solution of zinc chloride in water to provide a 7% by weight solution of the acrylonitrile based polymer. This polymer solution was discharged under pressure into a 25% by weight aqueous solution of zinc chloride through a nozzle having a hole diameter of 0.07 mm and a number of holes of 3000. The fibers so obtained were then washed with water to remove the solvent.

During this desolvation, hydrochloric acid was added to the washing water so that the pH of the washing water be 4.0. Thus, zinc was incorporated into the fibers in a proportion of 3.52 milli equivalent/100 g fiber, which corresponded to 80% of the equivalent of the sulfonic acid contained in the fiber, i.e., 4.4 milli equivalent/100 g fiber. Furthermore, during this desolvation, the fibers were stretched to 4 times their original strengths and then dried.

Thereafter, the fibers were stretched to 3.5 times their original lengths in saturated steam of 125° C., and acrylonitrile base strands of single fiber denier 1 and 3000 filaments were thus obtained.

The strands so obtained were subjected to oxidation treatment using air for 40 minutes in an oxidation apparatus as illustrated in FIG. 1 and maintained at a temperature of 255° C.

The free shrinkage of the acrylonitrile based polymer strands under the above oxidation conditions were measured until the amount of the bonded oxygen reached 3.5% by weight. The degree of shrinkage falling within the range of 20 to 50% of the free shrinkage was determined as illustrated by line (x) shown in FIG. 2. Until the amount of the bonded oxygen reached 3.5% by weight, the shrinkage of the strands was controlled as indicated by line (x) in FIG. 2.

After the oxidation treatment, the strands subjected to the oxidation treatment were again measured for the free shrinkage. The degree of shrinkage at each stage was determined as is illustrated by line (y) in FIG. 2 which falls within the range of 50 to 70% of the free shrinkage at the second stage of the oxidation treatment. Until the amount of the bonded oxygen reached 10% by weight, the shrinkage of the strands was controlled as indicated by line (y) in FIG. 2.

Figure 2:
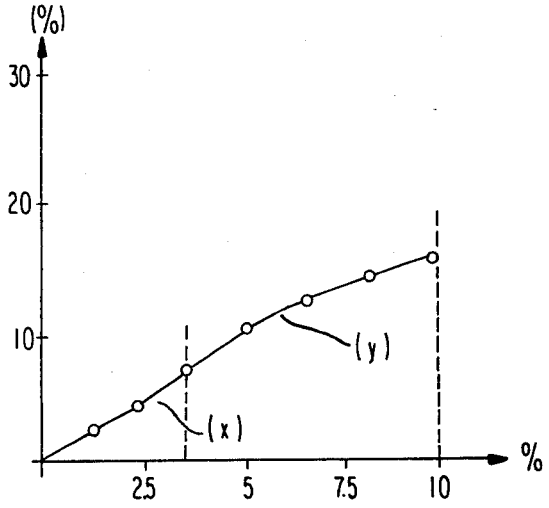
FIG. 2 shows the shrinkage controlling conditions in Example 2.

The symbols o on lines (x) and (y) in FIG. 2 correspond to the roller numbers in FIG. 1.

These oxidation treatments were good in operation. No fluffing took place and no troubles were encountered in winding.

The fibers so subjected to the oxidation treatments has a tensile strength of 3.5 g/denier and a tensile elongation of 12%.

The fibers so oxidized or rendered flame resistant were carbonized in nitrogen in a carbonization furnace maintained at 1350° C. During this carbonization, the shrinkage was limited to 7%, corresponding to 55% of free shrinkage.

The physical properties of the so obtained carbon fibers were as follows: tensile strength, 380 kg/mm$^2$; modulus of elasticity in tension; 25 ton/mm$^2$; tensile elongation: 1.52%. The carbon fibers were free from fluffing and had a quite high strength.

EXAMPLE 3

Acrylonitrile based fibers were prepared in the same manner as in Example 1 except that sodium acrylate was used in place of sodium methallyl sulfonate and in effecting the desolvation by water-washing of the spun filaments, the pH was kept at 4.5. Analysis of these fibers showed that the amount of acrylic acid was 7.4 milli equivalent/100 g fiber and the zinc content was 4.07 milli equivalent/100 g fiber which corresponded to 55% of the acrylic acid equivalent.

These fibers were subjected to oxidation using air at 260° C. for 35 minutes in an oxidation furnace as illustrated in FIG. 1. In this oxidation treatment, the free shrinkage of the fibers was 17% at the time the amount of bonded oxygen reached 3% by weight. Until the amount of bonded oxygen reached 3% by weight, the shrinkage of the fibers was limited within the range of 20 to 50% of free shrinkage (17%). That is the fibers were allowed to shrink at a degree of shrinkage of 3% until they came to roller No. 1, at 4.5% until roller No. 2, and at 6% until roller No. 3.

When the amount of bonded oxygen reached 3% by weight, the oxidized fibers were again measured in the free shrinkage. The fibers were allowed to shrink at 10%, 12%, 13% and 14%, respectively, until roller No. 4, roller No. 5, roller No. 6 and roller No. 7, so that the shrinkage of the fibers be controlled within the range of 50 to 70% of the free shrinkage.

Thus, good oxidized fibers were obtained, which were free of any trouble caused by fluffing and did not have coalescence. The tensile strength and the tensile elongation of the oxidized fibers were 3.3 g/denier and 10%, respectively.

These oxidized fibers were further subjected to carbonization at 1200° C. in an atmosphere of argon, during which the shrinkage of the fibers was limited to 7.54%, corresponding to 58% of the free shrinkage (13%).

The thus obtained carbon fibers had a tensile strength of 375 kg/mm$^2$ and a modulus of elongation in tension of 24 ton/mm$^2$. The number of fluffs of the carbon fibers was 10 per 5 m of the fiber. The carbon fibers did not have coalescence. This means that carbon fibers having a very small number of fluffs were obtained.

EXAMPLE 4

An acrylonitrile based polymer consisting of 0.35 mole % of sodium methallyl sulfonate, 1.27 mole % of methyl acrylate and 98.38 mole % of acrylonitrile was dissolved in a 60% aqueous solution of zinc chloride. The resulting polymer solution was wet-spun by discharging through fine holes, and the fibers so obtained were washed with water to remove the solvent. In this desolvation, the water-washing was controlled so that the zinc remained in the fibers in a proportion of 30, 60, 90 or 120% equivalent per equivalent of the sulfonic acid group provided by the above sodium methallyl sulfonate component.

The thus obtained fibers were dried and stretched in steam under pressure to thereby provide acrylonitrile based fibers of single fiber denier 1 and 3000 filaments.

For comparison, an acrylonitrile based polymer consisting of 1.9 mole % of methyl acrylate and 98.1 mole % of acrylonitrile (containing no sodium methallyl sulfonate) was subjected to the same treatment as above to provide comparative acrylonitrile based fibers.

These acrylonitrile based fibers were subjected to oxidation until the amount of bonded oxygen reached 12% by weight and then to carbonization, in the same manner as in Example 2. The relation between the amount of bonded oxygen and oxidation time in the above oxidation treatment, and the tensile strength of the obtained carbon fibers were measured. The results are shown in Table 1.

TABLE 1

| Kind of Fiber | Sample No. | Equivalents of Zinc per Equivalent of Sulfonic Acid (%) | Oxidation Time (min.) Amount of Bonded Oxygen (%) 3 | 6 | 9 | 12 | Tensile Strength of Carbon Fibers ($kg/mm^2$) |
|---|---|---|---|---|---|---|---|
| Fibers containing Sulfonic Acid | 1 | 5 | 10 | 21 | 33 | 41 | 320 |
| | 2 | 30 | 10 | 20 | 32 | 40 | 320 |
| | 3 | 60 | 7.5 | 16 | 23 | 31 | 350 |
| | 4 | 90 | 7 | 15 | 22 | 30 | 370 |
| | 5 | 120 | 7 | 14 | 21 | 28 | 280 |
| Comparative Fibers containing no Sulfonic Acid | 6 | 0 | 12 | 32 | 42 | 46 | 310 |
| | 7 | Same as (2) | 11 | 23 | 35 | 43 | 250 |

Note:
(1) Zinc (% by weight) by weight of Sample 7 is the same as Sample No. 2, and the content of zinc is 0.18% by weight.
(2) Sample Nos. 3 and 4 are according to this invention.

As can be seen from Table 1, the incorporation of zinc into the fibers containing no sulfonic acid (comparative examples) somewhat increases the oxidation rate. In those fibers containing sulfonic acid, the oxidation rate is increased more, and the incorporation of zinc into those fibers containing sulfonic acid increases the oxidation rate further.

In those fibers containing sulfonic acid and zinc, when zinc is present in a proportion of 30% equivalent per equivalent of the sulfonic acid group, the strength of the carbon fibers obtained is not so high, while when it is present in a proportion of 60 to 90% equivalent, the strength of the carbon fibers is markedly increased. When zinc is present in a proportion of 120% equivalent, the strength is rather reduced.

The use of only those fibers containing acidic groups and zinc of 50 to 100% equivalent per equivalent of the acidic group increases the oxidation rate and enables the production of carbon fibers of high strength. When the zinc contained is less than 50%, the effects of increasing the oxidation rate and the strength of carbon fibers are not marked, and when it is more than 100%, the strength of the carbon fiber is rather reduced.

EXAMPLE 5

A copolymerization reaction was conducted in a 60% $ZnCl_2$ aqueous solution containing 98 mole % of acrylonitrile, 2 mole % of methyl acrylate and sodium persulfate-sodium sulfate as redox polymerization catalyst to obtain a solution containing an acrylonitrile based polymer having 0.08 mole % of vinyl components in the polymer. The thus obtained polymer solution was wet-spun, water-washed and stretched in steam in the same manner as in Example 4. The fibers so obtained has zinc in a proportion of 0.66 milli equivalent/100 g fiber, which corresponded to 51% of the equivalent of the sulfonic acid contained in the fibers, i.e., 1.29 milli equivalent/100 g fiber. The thus obtained acrylonitrile based fiber was consisted of 6000 filaments and had a tensile strength of 7.1 g/denier, tensile elongation of 8.8% and Young's modulus of 80 g/denier.

While the invention has been described in detail and with reference to specific embodiments thereof, it will be apparent to one skilled in the art that various changes and modifications can be made therein without departing from the spirit and scope thereof.

What is claimed is:

1. A process for processing a carbon fiber which comprises subjecting an acrylonitrile based fiber composed of copolymers comprising at least 96 mole % of acrylonitrile and $1\times10^{-2}$ to $70\times10^{-2}$ mole % of one or more vinyl components containing acidic groups, 50 to 100% of the counter ions of the acidic groups being substituted by zinc, to oxidation treatment at 200° to 300° C. using plurality of roller units while limiting the shrinkage of said acrylonitrile based fiber to 20 to 50% of the free shrinkage as determined for that stage of the oxidation reaction until the amount of the bonded oxygen reaches 3 to 4% by weight, and upon subsequent oxidation treatment, limiting the shrinkage of the fiber to 50 to 70% of the free shrinkage as determined for the subsequent oxidation reaction to thereby produce an oxidized or flame resistant fiber, and then carbonizing the oxidized or flame resistant fiber in a non-oxidizing atmosphere at 500° to 2000° C. while limiting the shrinkage of the fiber to 40 to 70% of the free shrinkage.

2. The process of claim 1 wherein $5\times10^{-2}$ to $50\times10^{-2}$ mol percent of said one or more vinyl components is used.

* * * * *